United States Patent [19]

Woolf et al.

[11] 3,943,577

[45] Mar. 16, 1976

[54] TOILET TANK FLUSH CONTROL

[76] Inventors: Homer H. Woolf, 16409 E. 32nd St., Independence, Mo. 64055; Lucille M. Woolf, both of 16409 E. 32nd St., Independence, Mo. 64055

[22] Filed: Apr. 17, 1975

[21] Appl. No.: 569,004

[52] U.S. Cl. ..... 4/67 R; 4/34; 4/67 A

[51] Int. Cl.[2].. E03D 1/34; E03D 5/02; A61B 19/00

[58] Field of Search..... 4/34, 37, 57 R, 57 D, 67 R, 4/67 A, 52, 56, 53

[56] References Cited

UNITED STATES PATENTS

| | | | |
|---|---|---|---|
| 1,533,884 | 4/1925 | Minton | 4/67 R |
| 3,259,918 | 7/1966 | Walker, Sr. et al. | 4/18 |
| 3,860,972 | 1/1975 | Costello | 4/67 R |

*Primary Examiner*—Henry K. Artis

*Attorney, Agent, or Firm*—Lowe, Kokjer, Kircher, Wharton & Bowman

[57] ABSTRACT

A toilet tank flush valve provides for an auxiliary light flush without requiring any modification of the tank construction. A framework is adapted to be seated at the top of the flush tank. This framework also receives the flush tank lid. An auxiliary flush handle traverses the framework and is disposed on the outside of the tank for operation by a user. Linkage couples the auxiliary handle with the flush valve and operation of the handle actuates the auxiliary flush. The auxiliary flush is designed to allow only a relatively small volume of water flow through the tank.

4 Claims, 4 Drawing Figures

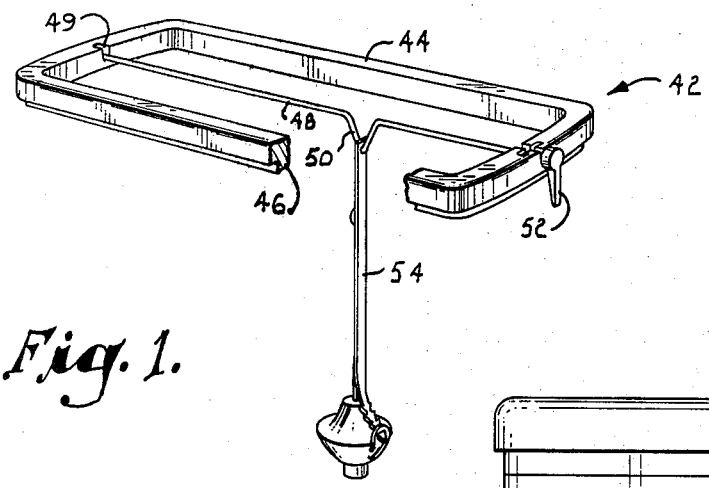
Fig. 1.
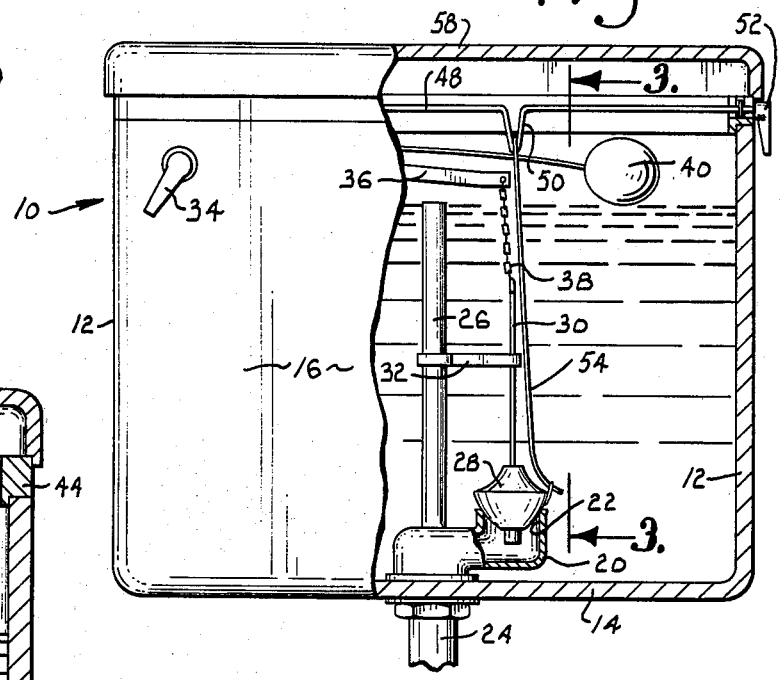
Fig. 2.
Fig. 3.
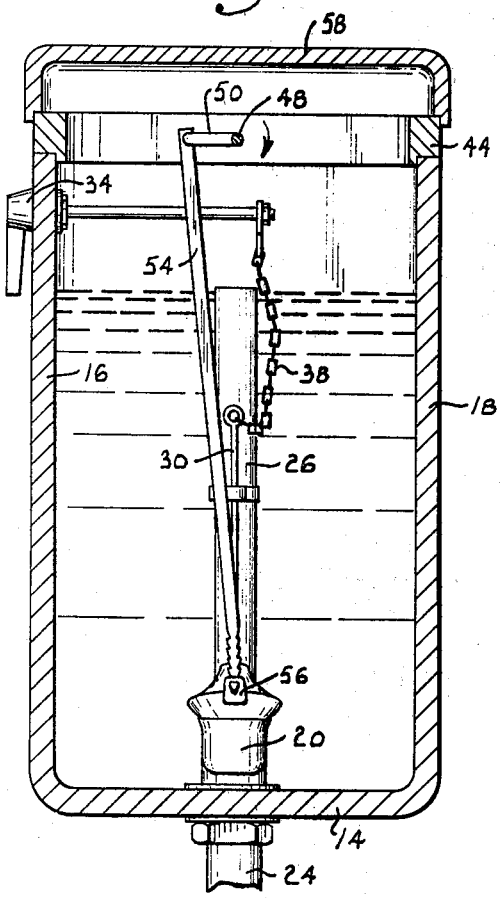
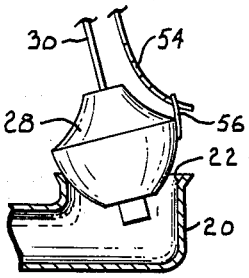
Fig. 4.

TOILET TANK FLUSH CONTROL

This invention relates to water conservation devices and, more specifically, to a toilet which can be flushed either using a small amount of water or a larger amount.

Conventional toilets offering only one flush using a given quantity of water often use more than is necessary to clean the toilet bowl and therefore waste a considerable quantity of water. Heretofore, attempts to produce a flush toilet having both light and heavy flush valves have been largely unsatisfactory. This has been attributable to their uneconomic construction and the fact that it is always necessary to in some way modify the existing toilet tank so as to accommodate an auxiliary flush control.

It is, therefore, a primary object of the present invention to provide a toilet tank flush control which allows for an auxiliary light flush of a toilet tank without requiring any modification of the existing toilet tank construction.

It is also an important aim of the present invention to provide an auxiliary flush control for a toilet tank which can be installed by the home owner without the need for any mechanical skill, special tools or the like.

An important aim of this invention is also to provide an auxiliary flush control as described above which does not interfere with the main flush in any way. Another important object of the invention is to provide an auxiliary flush control which can be adapted to fit any type of toilet tank and couple with any type of flush control.

Still another important objective of the invention is to provide an auxiliary flush control as described in the foregoing objects which is simple and economical to construct and mechanically reliable.

Other objects of the invention will be made clear or become apparent from the following description and claims when read in light of the accompanying drawing wherein:

FIG. 1 is a perspective view with portions broken away for purposes of illustration of the auxiliary flush control mechanism provided by the present invention;

FIG. 2 is a partially elevational, partially cross-sectional view of the auxiliary flush mechanism installed in the flush tank of a toilet;

FIG. 3 is a vertical, cross-sectional view taken along line 3—3 of FIG. 2; and

FIG. 4 is a fragmentary, cross-sectional view of the outlet opening at the bottom of the tank illustrating the manner in which the valve closing the outlet is opened to a small degree by the auxiliary flush mechanism.

Referring initially to FIG. 2 of the drawing, a toilet flush tank is designated generally by the numeral 10 and includes integrally molded side walls 12, a bottom 14 and front and back walls 16 and 18, respectively.

An outlet basin 20 is disposed in the bottom of tank 10 and presents an outlet opening 22. Basin 20 communicates with a conduit 24 which passes water from tank 10 into the toilet bowl (not shown).

An overflow pipe 26 also communicates with basin 20. Seated on the uppermost peripheral lip of basin 20 is a manually-operated ball cock valve 28. Valve 28 is preferably constructed of a flexible rubber-like material so as to accommodate a degree of yielding for purposes to be made clear hereinafter. Extending upwardly from valve 28 and coupled with the latter is a valve stem 30 which passes through a sleeve guide 32 rigid with overflow pipe 26.

A handle 34 extends trhough front wall 16 of the tank and is coupled with an actuating arm 36. A flexible chain linkage 38 extends from arm 36 to valve stem 30. Also coupled with handle 34 is a float 40 of a type well known to those skilled in the art. The details of construction of handle 34 and associated mechanism have been omitted for the sake of clarity and brevity. It is to be understood, however, and will be apparent to those skilled in the art, that a water inlet is provided which is controlled by a valve also actuated by handle 34 and controlled by float 40.

The foregoing described components all comprise a part of a conventional toilet tank construction as is well known in the art. Turning now to the details of the present invention which is designated generally by the numeral 42 in FIG. 1, it is seen the auxiliary flush control mechanism 42 comprises a generally rectangular framework 44 having a depending skirt portion 46 and adapted to be seated on the flush tank 10 in the manner illustrated in FIG. 2.

Extending lengthwise of framework 44 is a shaft 48 provided with a generally V-shaped offset 50 and mounted for pivotal movement in a slot 49 of the framework. Traversing framework 44 and receiving one end of the shaft 48 is an auxiliary flush handle 52 which extends on the outside of tank 10. Extending downwardly from offset 50 is a flexible strip link 54 which is coupled with a tab projection 56 at the edge of valve 28.

Enclosing tank 10 is a lid 58 which seats upon framework 44. Manifestly, lid 58 is normally disposed on the upper periphery of tank 10 and no modification of the lid is necessary to adapt it to framework 44.

In use, auxiliary flush control 42 is easily mounted in a conventional flush tank without modification of the tank and without the need for special tools or a master plumber's skill. Flexible link 54 is coupled with valve 28 at one edge of the latter as illustrated in the drawing. Tab 56 may be adhesively secured to the valve in order to facilitate this coupling. Other types of connectors may be used to secure the flexible link to the ball valve. It is desirable to secure the flexible link at one side of the valve so that when handle 52 is turned to exert a lifting force on the valve through linkage 54, the valve will be canted to some degree as indicated in FIG. 4 of the drawings. To facilitate this flexing, it is desirable that ball valve 28 be constructed from a flexible material as is commonly done so as to accommodate a certain degree of canting. Alternatively, in those toilet tanks where a flapper valve is utilized, the canting may easily be accomplished by lifting one edge of the flapper valve.

Handle 52 is turned slightly so as to accomplish the lifting action and allow the desired quantity of water to pass through basin 20 and into the toilet bowl. The handle is held in an open position until the desired amount of water has passed through the bowl.

On the other hand, when a full flush is desired, handle 34 is operated in the normal manner to completely lift ball valve 28 off of its seat on basin 20 and allow the full contents of the tank to empty into the toilet bowl. It will be appreciated that the auxiliary flushing mechanism in no way interferes with this normal operation of the toilet. By using the auxiliary flush mechanism is those instances where a full flush is not needed, considerable water savings may be accomplished. The device will pay for itself in a short amount of time in the quantity of water saved.

To the best of our knowledge, no previously existing auxiliary flush control mechanism has been so simple in construction and so easily adapted to existing toilet bowls than our device. The device is particularly susceptible to consumer approval because it does not require any permanent damage or structural modification to the toilet tank to be installed. An individual who moves frequently from one residence to another can easily take the auxiliary flush control mechanism with him from one location to the next without in any way damaging the permanent toilet installation.

Having thus described the invention, what is claimed as new, and desired to be secured by Letters Patent, is:

1. For use with a toilet tank having a flush box, a lid closing said box, an outlet communicating the flush box with the toilet; a valve normally closing said outlet and movable to an open position to allow the passage of water through the outlet; and means for opening and closing said valve; the improvement comprising:

a framework adapted to be seated on said box at the upper periphery thereof, said framework being adapted to receive said lid and hold the latter on the box to close the latter;

handle means traversing the framework and projecting on the outside of the flush box; and means adapted for coupling said handle means with said valve whereby movement of the handle means opens the valve to allow the passage of water through said outlet.

2. The invention of claim 1, wherein said framework is characterized by a peripheral configuration complemental to the configuration of said flush box.

3. The invention of claim 1, wherein said valve is characterized by construction from a flexible material and said means coupling the handle means with the valve comprises linkage coupled with said valve at one side of the latter for exerting a force tending to cant said valve relative to said outlet.

4. The invention of claim 1, wherein said coupling means comprises a shaft extending from said handle means to at least a point over said valve and flexible linkage extending downwardly from the shaft to couple the valve with the shaft.

* * * * *